United States Patent [19]

McBride

[11] Patent Number: 4,469,194

[45] Date of Patent: Sep. 4, 1984

[54] NON-SLIP RESILIENT LADDER SUPPORT

[76] Inventor: Thomas D. McBride, 559 Chestnut St., Westwood P.O., N.J. 07675

[21] Appl. No.: 544,018

[22] Filed: Oct. 21, 1983

[51] Int. Cl.³ ..... E06C 7/48

[52] U.S. Cl. ..... 182/107; 182/214; 248/210

[58] Field of Search ..... 182/107, 108, 214, 46, 182/220; 248/214, 210, 238

[56] References Cited

U.S. PATENT DOCUMENTS

| | | | |
|---|---|---|---|
| 1,964,067 | 6/1934 | Leach | 182/108 |
| 2,904,128 | 9/1959 | Boham | 182/108 |
| 2,925,877 | 2/1960 | Wright | 182/108 |
| 3,037,579 | 6/1962 | Barrow | 182/107 |
| 3,062,319 | 11/1962 | Wright | 182/108 |
| 3,115,212 | 12/1963 | Keatley | 182/108 |
| 3,662,856 | 5/1972 | D'Amico | 182/108 |
| 3,993,163 | 11/1976 | Barrett | 182/108 |
| 4,369,860 | 1/1983 | Beane | 182/107 |

*Primary Examiner*—Reinaldo P. Machado

*Attorney, Agent, or Firm*—Ralph R. Roberts

[57] ABSTRACT

This application provides an attachable non-slip ladder support for and on an upper rung of a ladder with a typical stile and rung construction. This support has a shell-like member having an internal configuration which is sized and adapted for slidable mounting on this upper rung. Intermediate this shell-like member and fixedly secured to its outer surface is a resilient non-skid member which is typically of sponge-like material. This member is secured by adhesive, rivets or the like. Clamp members are used at each end of this resilient support to removably secure the support assembly to the rung in the selected desired attitude. These clamp members insure that the support is not moved during use so that the resilient portion protrudes ahead of the stiles.

7 Claims, 3 Drawing Figures

NON-SLIP RESILIENT LADDER SUPPORT

BACKGROUND OF THE INVENTION

1. Field of the Invention

With reference to the classification of art as established in and by the United States Patent Office this invention is believed to be found in the General class identified as "Fire Escapes, Ladders and Scaffolds" (Class 182) and more particularly to ladders and with supporting surface compensating means and particularly to a rung attachment that provides means for resting safely against a pole, tree or the like.

2. Description of the Prior Art

Ladders and particularly extension ladders have been used for many years. Efforts and apparatus for providing means to contact the resting surface without damage and with safety has been the subject of many patents. U.S. Pat. No. 4,394,387 to SPINKS as issued July 26, 1983 is a patent directed to providing a standoff device used with a ladder. In this patent there are twenty references cited and in the art there are many more directed to add-on apparatus used with ladders to prevent scuffing, marking or to prevent slippage. By and large these prior devices are directed to ladders that are leaned against walls usually of a great extent. When a flat surface is engaged the stile ends of the ladder are covered or attachments are made to insure that the ends (often sharp metal) are covered and/or other protection of these ends are provided. Often this protection is rubber boots, tape ends or the like. Wheels or similar devices are also known. Where and when the ladder must rest against a rounded surface such as a pole or tree trunk the safety of the user is more precarious since the stiles are usually not engaged and the rung assumes the load.

SUMMARY OF THE INVENTION

This invention may be summarized, at least in part, with reference to its object.

It is an object of this invention to provide, and it does provide, an attachment to a rung of a ladder wherein a secured soft rubber member is positioned to provide a supporting means at either flat, semi-flat or rounded surfaces and with the soft rubber or rubber-like portion sufficiently resilient so as to conform to the engaged surface and retain the engagement of the support during use.

In brief, this support member includes a metal semi-circular length of tubing with end members extending sufficiently for clamping these extending portions to a rung of a ladder. The support member is positioned so that an attached sponge rubber portion extends forwardly and is clamped in this position so as to retain this attitude during use. The sponge rubber or rubber-like portion is sufficient to provide a support surface when the ladder is placed against a member such as a wall, tree or pole. This sponge rubber portion is sufficiently resilient to accommodate itself to that surface against which it rests.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a non-slip, resilient ladder support as adopted for use with a ladder with rungs and showing a preferred means for securing the support. This specific embodiment has been chosen for the purposes of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to like members throughout the three figures of the drawing.

DESCRIPTION OF THE PREFERRED EMBODIMENT

Figure 1:
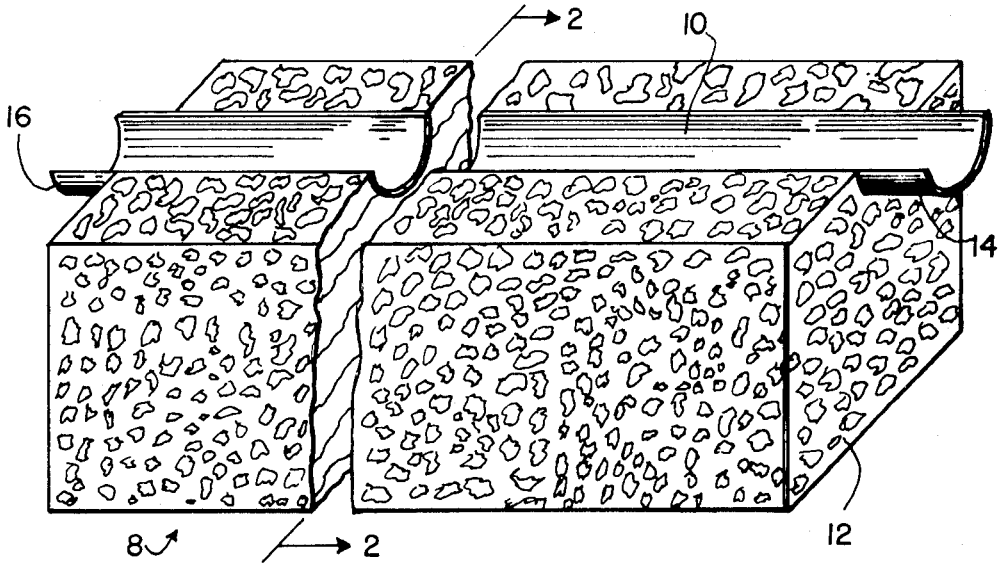
FIG. 1 represents an isometric view of the support member assembly of this invention.
Figure 3:
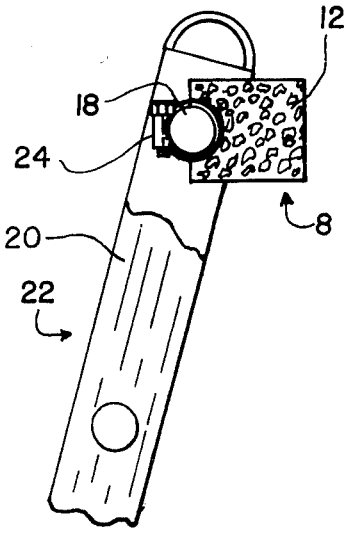
FIG. 3 represents in a further reduced scale a side view partly diagrammatic and fragmentary of a ladder end and showing the support of this invention clamped to a rung of a ladder with this clamped support positioned and secured for use.
Figure 2:
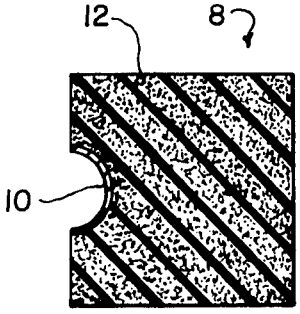
FIG. 2 represents a sectional view in a partially reduced scale with this view taken on the line 2—2 and looking in the direction of the arrows.

In FIGS. 1, 2 and 3 is depicted the preferred embodiment of the ladder support 8 of this invention. As illustrated, a semi-circular tubular portion 10 is usually made as an aluminum extrusion or is made from aluminum tubing severed lengthwise. The internal diameter of portion 10 is sized so as to easily lay against a rung of a ladder to which it is to be secured. This semi-circular member 10 is secured to a sponge rubber or like member 12. This is usually of a plastic composition since sponge production is usually by high speed foaming production methods. Adhesive and/or rivets are used to secure this member 12 to the member 10 as seen in FIGS. 1 and 2.

As seen in FIG. 1 the member 10 is made of a length greater than the extent of the sponge member 12. These extending end portions are identified as 14 and 16. The inner diameter of member 10 is sized to seat on the outer diameter of a rung 18 extending between stiles 20 of a ladder 22. This ladder may be of metal or wood but the rungs used therewith are round or substantially round. Clamps 24 are removably secured to the ends 14 and 16 and tightened to retain the support 8 in the desired attitude. The face portion of the resilient member 12 is substantially parallel to the surface against which the ladder 22 is caused to lean.

USE AND OPERATION

A ladder 22 which is of the stile and rung type is usually leaned against a wall, tree or pole for painting, repair, cutting down or trimming. Whatever the reason for use, the attachment of the support 8 is desired. Clamps 24 are positioned around a rung 18 which is usually the topmost rung 18 of the ladder 22 so that the support may extend exterior of the placed ladder. The clamps 24 are now tightened sufficiently so that the support 8 does not and is not susceptable for turning around the rung. These clamps may be the screw-type or may be other types that provide tightening for positively securing the sponge portion 12 so that this sponge portion provides the contact surface.

The sponge rubber or rubber-like portion 12 is made about four inches square (cross section) so as to extend substantially forward of the rung 18. When this sponge is placed in contact with a tree or pole it not only conforms to the contour of the pole, tree or wall but as a resilient portion is non-skid. This is very important in the cutting of a tree or working on a building when a corner or curved portion is the supporting surface.

The rung 18 is usually round but there is also known rungs with flattened surfaces to provide a larger support surface for a foot of the user. No matter the shape the member 10 is secured to the rung 18 by clamps 24 so that in a secured state the support 8 is fixedly secured. Shifting of the support 8 is not desired or appreciated by the user when he or she is a great distance above the ground. The support 8 is contemplated to be inexpensive and after the sponge portion 12 becomes damaged a new support may be used. The support 8 may be retained on a ladder rung for storage since it is usually attached to the upper rung and in extension ladders the upper portion usually extends above the lower (outer) section for storage.

The sponge member 12 is comparable to that provided for washing of cars and the like and is similar to the sponge material used in cushions and the like. The sponge material is sufficiently soft that a compression of at least one third is easily achieved. When a tree or pole is encountered the sponge usually forms a semi-circle.

In the use of resilient member 12 the depicted cross section of generally square is not limiting but it is desirable that the supporting face and associated portion be sufficient to support the leaned ladder and user without the stile or rail 20 engaging or nearly engaging the supporting wall, tree, pole and the like. It is essential that this resilient member 12 with its non-skid properties be effective and that the ends of the stiles or rails 20 not bear support pressures since the non-skid and deformable characteristics of the member 12 is desired and employed. It is noted that the description and claims anticipate the ladder support as used with a ladder which is adapted to be leaned for use. This ladder may be a long ladder or an extension ladder but the use of a support as above described is usually not required when a step ladder is employed as these hinged ladders are usually self supporting and do not require a lean in which the top end is placed against a wall, corner, tree, pole and the like. Conventionally the projection of the resilient support is at least one inch beyond a stile before the support is engaged by a surface against which the ladder is leaned. Of note is the use of this support for ladders that provide access to steel or like metal beams. The resting of the stile ends against a flange portion often brings movement of the leaned ladder along the beam whereas the resilient non-skid support of this invention eliminates this hazzard.

The screw clamps may be any conventional type but ease of mounting, removal and use is essential. The clamp means secure the support in a fixed attitude so as to not to permit the support to rotate around the rung during use. The clamp is contemplated to be of the strap type such as is used with radiator hose and the like. These clamps have a screw and some have a nut and some have a screw thread formed in the strap. Other clamp means may be used as long as the extending and portions 14 and 16 are retained against the rung.

Terms such as "left", "right", "up", "down", "bottom", "top", "front", "back", "in", "out" and the like are applicable to the embodiment shown and described in conjunction with the drawing. These terms are merely for the purposes of description and do not necessarily apply to the position in which the non-slip resilient ladder support may be constructed or used.

While a particular embodiment of said support has been shown and described it is to be understood the invention is not limited thereto and protection is sought to the broadest extent the prior art allows.

What is claimed is:

1. A non-slip resilient ladder support for ladders of rung and stile construction and characterized as having at least one of the top rungs adapted to retain such a support, the ladder also of a type adapted for leaning against a wall, corner, tree, pole and the like, said non-slip resilient support including:

(a) a shell-like member providing an internal configuration sized and adapted for slidable mounting on a rung of a ladder to which it is to be mounted and less than the length between stiles;

(b) a resilient non-skid member having a length less than the length of the shell-like member and secured to said shell-like member so as to provide extending portions at each end of the shell-like member, and (c) clamp means adapted to engage each extending end of the shell-like member and when secured and/or tightened retain the ladder support so as to not move during use and with the resilient portion extending at a desired attitude and with at least a portion of the resilient portion extending at least one inch beyond the stile.

2. A non-skid resilient ladder support as in claim 1 in which the resilient non-skid member is rubber or rubber-like material having a durometer of twenty to forty.

3. A non-skid resilient ladder support as in claim 1 in which the resilient non-skid member is foam rubber or rubber-like material.

4. A non-skid resilient ladder support as in claim 1 in which the shell-like member is a thin metal member such as a one-half tubular configuration.

5. A non-skid resilient ladder support as in claim 4 in which the metal member is a split aluminum tube adhesively attached to the resilient member.

6. A non-skid resilient ladder support as in claim 1 in which the clamp means is a screw-type clamp tightened and loosened by a screw driver, allen wrench and the like.

7. A non-skid resilient ladder support as in claim 6 in which the clamp is a screw-thread type in which the strap is formed with a spiral lead portion to accommodate a screw thread of a screw member.

* * * * *